United States Patent [19]

Göpfert

[11] Patent Number: 4,919,565

[45] Date of Patent: Apr. 24, 1990

[54] COMPOSITE STONE SET

[76] Inventor: Reinhard Göpfert, Hannoversche Str. 156, D-3070 Nienburg, Fed. Rep. of Germany

[21] Appl. No.: 267,312

[22] Filed: Oct. 21, 1988

[30] Foreign Application Priority Data

Oct. 23, 1987 [DE] Fed. Rep. of Germany ..... 3735865

[51] Int. Cl.[5] ..... F01C 5/06

[52] U.S. Cl. ..... 404/41; 52/590

[58] Field of Search ..... 404/41, 42; D25/113, D25/114, 115, 116; 52/593, 590, 608

[56] References Cited

U.S. PATENT DOCUMENTS 4,773,790 9/1988 Hagenah ..... 404/41

*Primary Examiner*—William P. Neuder

*Attorney, Agent, or Firm*—Peter K. Kontler

[57] ABSTRACT

Dodecagonal stones and octagonal stones are used to produce a stone formation for the surface reinforcement of roads, public squares, walks and the like. On each stone, four oppositely disposed sides define two corners pointing towards the center of the stone.

3 Claims, 1 Drawing Sheet

COMPOSITE STONE SET

Figure 1:
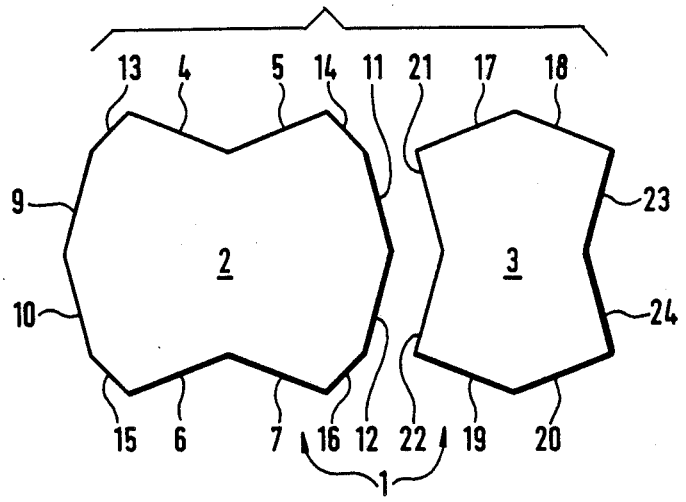

The invention relates to a set of stones for the production of an interlocking stone formation for the surface reinforcement of roads, public squares, walks and the like from a dodecagonal stone and an octagonal stone which engages the same.

Composite stones of concrete are prefabricated in production molds. Gaps are present between the walls of the mold and the edges of a layer of composite stones, and these are reduced in size by stone halves to improve the balance of the mold. The gaps in the prefabricated composite layers are also disadvantageous for packing. Packing straps are used to firmly pack a stack of stones consisting of a plurality of composite layers. They tilt the stones which are disposed at the gaps between stones, and this causes loosening of the entire stack thereby destroying the prefabricated arrangement of the stones. The use of stone halves is thus also necessary for the transport of a stack of prefabricated composite layers. They prevent tilting of the stones and maintain the packing straps under tension. Upon laying the composite layers with a machine, however, the stone halves are frequently brought into contact with one another which is undesired. The stone halves must be removed by hand and replaced by complete stones. This operation can be performed only after deposition of the prefabricated arrangement on the sand surface and must be carried out prior to loading of the arrangement with the laying machine. Accordingly, additional personnel are required.

It is an object of the invention to create stone shapes which can be laid mechanically without the need to subsequently remove stone halves by hand and to replace the same with complete stones. The gaps at the edges of a stone formation are to be as small as possible. The forces which are operative on a stone surface and arise, for example, due to the braking and acceleration of motor vehicles, are to be distributed to neighboring stones.

The invention is characterized in that four oppositely disposed sides on each of the dodecagonal stone and the octagonal stone define two corners which point to the center of the stone. The sides of the octagonal stone preferably have the same length. In the dodecagonal stone, eight sides can have the same length while the remaining four sides, where the dodecagonal stones of a formation directly contact one another, can have equal lengths but are shorter than the eight other sides. This allows the free spaces between the edges of the stones and the walls of the mold to be reduced to a minimum during production.

The tangential forces which arise on a stone surface, for example, during braking of a motor vehicle, are transmitted to at least three, and preferably five, neighboring stones depending upon the direction of loading. A rectangular stone, in contrast, transmits forces to two or three neighboring stones, again depending upon the direction of loading. None of the currently known stone shapes are capable of distributing the forces which arise during braking or acceleration as effectively as the stones of the invention. As the forces acting on a stone branch out, loading of the overall stone formation decreases. Loss of individual stones during transport and the accompanying loosening of the packing straps are not possible because of the dovetail connections between stones. The edges of a prefabricated formation according to the invention are not as deeply indented as known composite stones so that the production molds can be better balanced.

An exemplary embodiment of the invention is illustrated in the drawings and described below.

In the drawings

Figure 2:
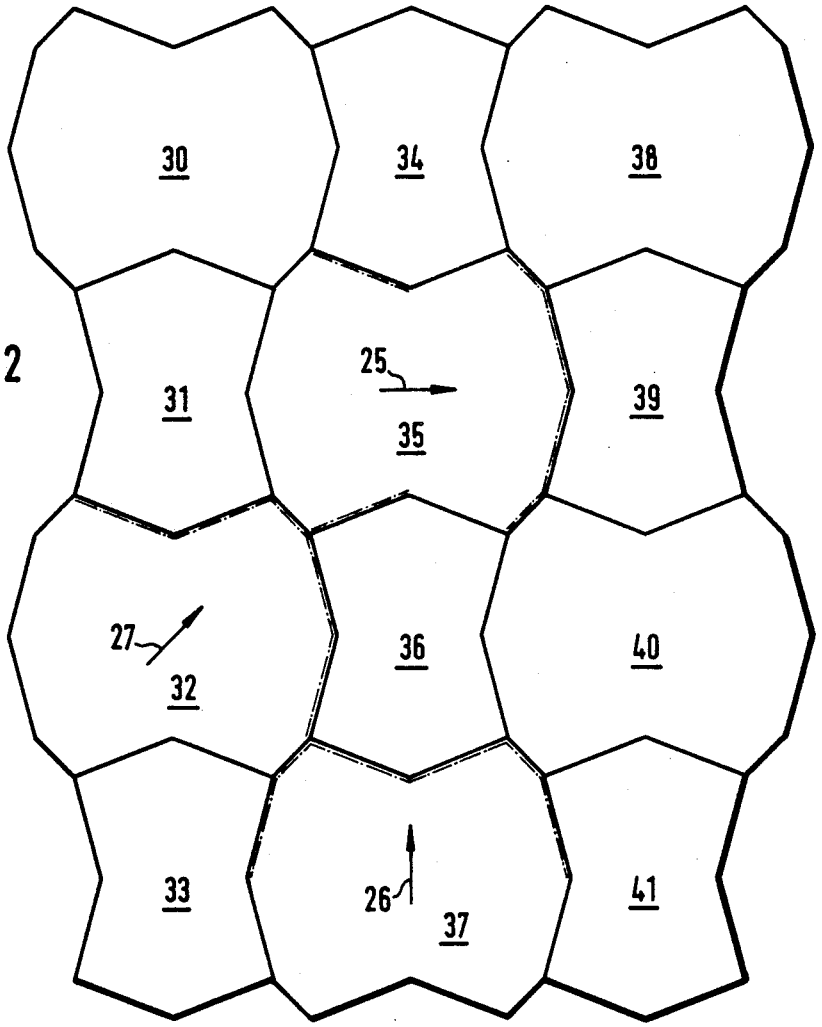

FIG. 1 shows a dodecagonal stone and octagonal stone of a set of stones in accordance with the invention; and FIG. 2 shows a prefabricated stone formation made with the stones of FIG. 1 and exhibiting a fishbone pattern which is preferred when forces act in different directions.

The set of stones 1 consists of the dodecagonal stone 2 and the octagonal stone 3. The longitudinal axes of the two stones are perpendicular to one another.

The sides 4 to 7 of the dodecagonal stone point inwards, that is, are directed concavely. The remaining eight sides 9 to 16 form the convex parts of the stone. The sides 4 to 12 have the same length while the sides 13 to 16 have equal lengths but are shorter than the sides 4 to 12. All sides 17 to 24 of the octagonal stone 3 have the same length. Of these, the sides 21 to 24 are concave, that is, are directed inwards to define a waist of the stone.

FIG. 2 illustrates that, upon loading a dodecagonal stone 35 in the direction of the arrow 25, the forces are transmitted to five neighboring stones 34, 38, 39, 40, 36 with a corresponding reduction in the load on the stone 35. When a dodecagonal stone 37 is loaded in the direction of the arrow 26, five stones 33, 32, 36, 40, 41 help absorb the resulting forces. Loading of the dodecagonal stone 32 in the direction of the arrow 27, that is, at approximately 45° to the direction of the arrow 25, still results in a loading of at least three neighboring stones 31, 35, 36. The loading of an octagonal stone with force components corresponding to the arrows 25 to 27 results in the transmission and distribution of the resulting forces to two or three neighboring stones. The sides of the stones which transmit force to neighboring stones are accentuated by a double line. Due to the perpendicularity of the longitudinal axes of the two stones 2 and 3 constituting a set of stones 1, a fishbone pattern having recognized advantages is automatically obtained upon laying of the stones 30–41 of FIG. 2.

I claim:

1. A set of stones for the production of an interlocking stone formation for the surface reinforcement of roads, public squares, walks and the like from a dodecagonal stone and an octagonal stone which engages the same, characterized in that four oppositely disposed sides (4, 5, 6, 7 and 21, 22, 23, 24) on each of the dodecagonal stone (2) and the octagonal stone (3) define two corners pointing towards the center of the stone.

2. A set of stones according to claim 1, characterized in that all sides (17 to 24) of the octagonal stone (3) have the same length.

3. A set of stones according to claim 1, characterized in that eight sides (4 to 7 and 9 to 12) of the dodecagonal stone (2) have the same length while the remaining four sides (13 to 16), where the dodecagonal stones (2) in the formation directly about one another, have equal lengths but are shorter than the remaining eight sides (4 to 7 and 9 to 12).

* * * * *